US007455767B2

(12) United States Patent
Pamperin

(10) Patent No.: US 7,455,767 B2
(45) Date of Patent: Nov. 25, 2008

(54) DEBRIS GATHERING DEVICE FOR SWIMMING POOLS

(76) Inventor: Roger F. Pamperin, 3812 62nd Dr., Lubbock, TX (US) 79413

( * ) Notice: Subject to any disclaimer, the term of this patent is extended or adjusted under 35 U.S.C. 154(b) by 293 days.

(21) Appl. No.: 11/431,471

(22) Filed: May 10, 2006

(65) Prior Publication Data

US 2007/0262007 A1 Nov. 15, 2007

(51) Int. Cl.
*E04H 4/16* (2006.01)

(52) U.S. Cl. ..... 210/167.2; 210/167.19

(58) Field of Classification Search ..... 210/167.1, 210/167.19, 167.2, 416.1, 416.2; 4/496
See application file for complete search history.

(56) References Cited

U.S. PATENT DOCUMENTS

| | | | | | |
|---|---|---|---|---|---|
| 3,372,809 | A | * | 3/1968 | Spitzer | 210/167.19 |
| 4,089,074 | A | | 5/1978 | Sermons | |
| 4,889,622 | A | * | 12/1989 | Newcombe-Bond | 210/167.15 |
| 5,264,122 | A | | 11/1993 | Lakotish | |
| 5,279,728 | A | * | 1/1994 | Weiss | 210/167.2 |
| 5,350,508 | A | | 9/1994 | Van der Watt | |
| 5,536,397 | A | * | 7/1996 | D'Offay | 210/167.19 |
| 5,759,388 | A | | 6/1998 | Cote | |
| 5,788,850 | A | * | 8/1998 | Tuomey | 210/167.2 |
| 5,849,184 | A | | 12/1998 | Veillet | |
| 5,911,878 | A | | 6/1999 | Benvenuto et al. | |
| 5,919,359 | A | * | 7/1999 | Bisseker | 210/167.19 |
| 6,041,453 | A | * | 3/2000 | Barrow et al. | 4/496 |
| 6,086,759 | A | * | 7/2000 | Bisseker | 210/167.19 |
| 6,187,181 | B1 | | 2/2001 | Stoltz et al. | |
| 6,270,683 | B1 | | 8/2001 | Turner | |
| 2004/0232058 | A1 | * | 11/2004 | Silverstein | 210/169 |
| 2005/0279682 | A1 | * | 12/2005 | Davidson et al. | 210/169 |

FOREIGN PATENT DOCUMENTS

| | | | |
|---|---|---|---|
| WO | WO 2004/042173 | * | 5/2004 |

* cited by examiner

*Primary Examiner*—Fred Prince
(74) *Attorney, Agent, or Firm*—Locke Lord Bissell & Liddell, LLP

(57) ABSTRACT

A device for gathering debris floating at or near the surface of a swimming pool, the device having a spray head assembly releasably installable in front of an in-wall skimmer on a side of the swimming pool, the spray head assembly comprising a connector through which a pressurized flow of water is receivable from an external source; an inlet duct assembly pivotably connected to the spray head assembly; and an elongate debris collection bag releasably attachable to the inlet duct assembly, the collection bag extending into the pool at or near the water surface and substantially perpendicular to that portion of the pool wall adjacent to the spray head assembly, and having at least one water outlet disposed distally from the inlet duct assembly.

23 Claims, 6 Drawing Sheets

DEBRIS GATHERING DEVICE FOR SWIMMING POOLS

BACKGROUND OF THE INVENTION

1. Field of the Invention

This invention relates to apparatus useful for removing from swimming pools any plant, animal or other lightweight debris that floats at or near the surface, especially at times when the volume of such debris exceeds the normal holding capacity of conventional pool skimmer baskets.

2. Description of Related Art

Those who own or maintain swimming pools are well familiar with problems that arise periodically from the volume of debris that is blown or otherwise carried into a pool, especially at certain times of the year. During spring, for example, pool skimmers may become overfilled and clogged with detritus from budding or blooming plants, swarming insects, or the like, or from bark mulch that is washed from plant beds into the pool by runoff from heavy spring rains. Falling blossoms from flowering shrubs and trees can overfill skimmer baskets several times in a single day during spring and summer, as can falling leaves during autumn. General debris such as dry grass, twigs, pieces of paper, plastic, bird feathers, and the like can be blown into a pool at any time of the year, and particularly during high winds or thunderstorms. Much of the debris typically floats at or near the water surface (such as within about 6 inches of the water surface) for a period of time, and if not removed, sinks to the pool bottom where it can also clog drains or pool sweeping devices.

Numerous devices have previously been disclosed for use in alleviating these and other related pool maintenance problems. Some of such devices are disclosed, for example, in U.S. Pat. Nos. 4,089,074; 4,889,622; 5,264,122; 5,350,508; 5,759,388; 5,849,184; 5,911,878; 6,187,181; and 6,270,683. Notwithstanding the advances in the art previously made, however, there remains a need for an inexpensive but reliable pool skimming apparatus that will effectively capture debris floating at or near the water surface and store a sufficient volume of such debris that the apparatus does not require cleaning as frequently as conventional pool skimmer baskets.

SUMMARY OF THE INVENTION

A device is disclosed that is useful for gathering debris floating at or near the surface of a swimming pool. The subject device can be easily installed in a pool and, if desired, removed when not in use. The apparatus has a large collection bag with a capacity sufficient to hold many times the amount of floating debris that can be contained in the basket of a conventional swimming pool skimmer. The collection bag is releasably attached to an inlet duct assembly having a lightweight frame that holds one end of the collection bag open and is preferably pivotably connected to a spray head assembly to accommodate rising and falling water levels in the pool.

The collection bag preferably includes at least one float and weight located in the closed end of the bag, which cooperate with the frame of the inlet duct assembly to hold the bag at or near the water surface so that debris can flow freely into the bag during use. The frame of the inlet duct assembly, which is desirably easily detachable from the spray head assembly, preferably includes a perimeter section to which the open end of the collection bag is attachable, a venturi duct communicating with the open end of the collection bag, and at least one flotation member to maintain the venturi duct at or near the water surface. The spray head assembly is desirably installed in front of a pool skimmer opening and receives water from a conventional water hose. The water is discharged through a plurality of spaced-apart spray heads into the mouth of the inlet duct assembly. The water spray heads cooperate with the pool skimmer to redirect floating debris toward the collection bag. Although water is drawn toward the skimmer from the pool water surface on both sides of the collection bag, a baffle assembly disposed between the spray heads and the skimmer prevents large debris, especially leaves, from entering the skimmer, and the spray heads cooperate with the venturi duct in the inlet duct assembly to accelerate the water flow into the open end of the collection bag. The water spray heads thus cooperate with both the venturi duct and the baffle assembly to establish a dual-sided water circulation pattern that causes debris to flow into the collection bag from both sides of the apparatus. The baffle assembly prevents all debris except for very small and lightweight debris from entering the pool skimmer while the apparatus is in use.

BRIEF DESCRIPTION OF THE DRAWINGS

The apparatus of the invention is further described and explained in relation to the following drawings wherein.

Like reference numerals are used to identify like parts in all figures of the drawings.

DESCRIPTION OF THE PREFERRED EMBODIMENTS

The preferred embodiment of the subject debris gathering device as disclosed herein is primarily intended for use in gathering debris that is floating either on the water surface or a short distance, such as less than a foot, and more commonly, about 4 to 8 inches, below the water surface of a conventional in-ground swimming pool. It will be apparent upon reading this disclosure, however, that the device of the invention can be similarly configured for use in an above-ground pool if desired. Similarly, although the embodiment disclosed herein is operated manually by starting or stopping the flow of water through a water hose connected to the device, it will be appreciated by those of skill in the art upon reading this disclosure that timers, solenoid-controlled valves and other similarly effective control means, can also be utilized to automate operation of the device within the scope of the invention.

Figure 1:
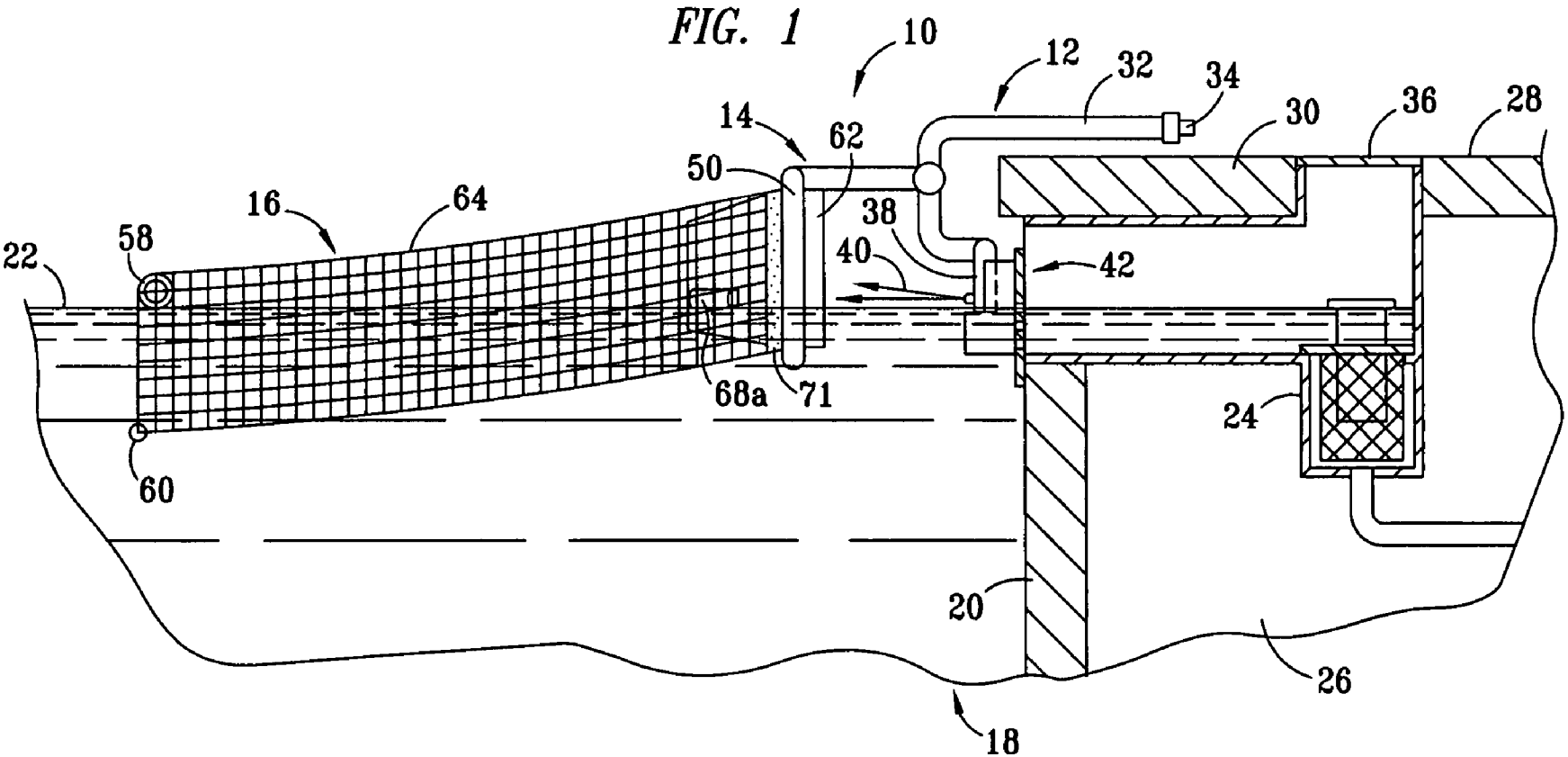
FIG. 1 is a side elevation view of a preferred embodiment of the apparatus of the invention as installed in front of a conventional skimmer installation of an in-ground swimming pool, which is shown in cross-section.
Figure 2:
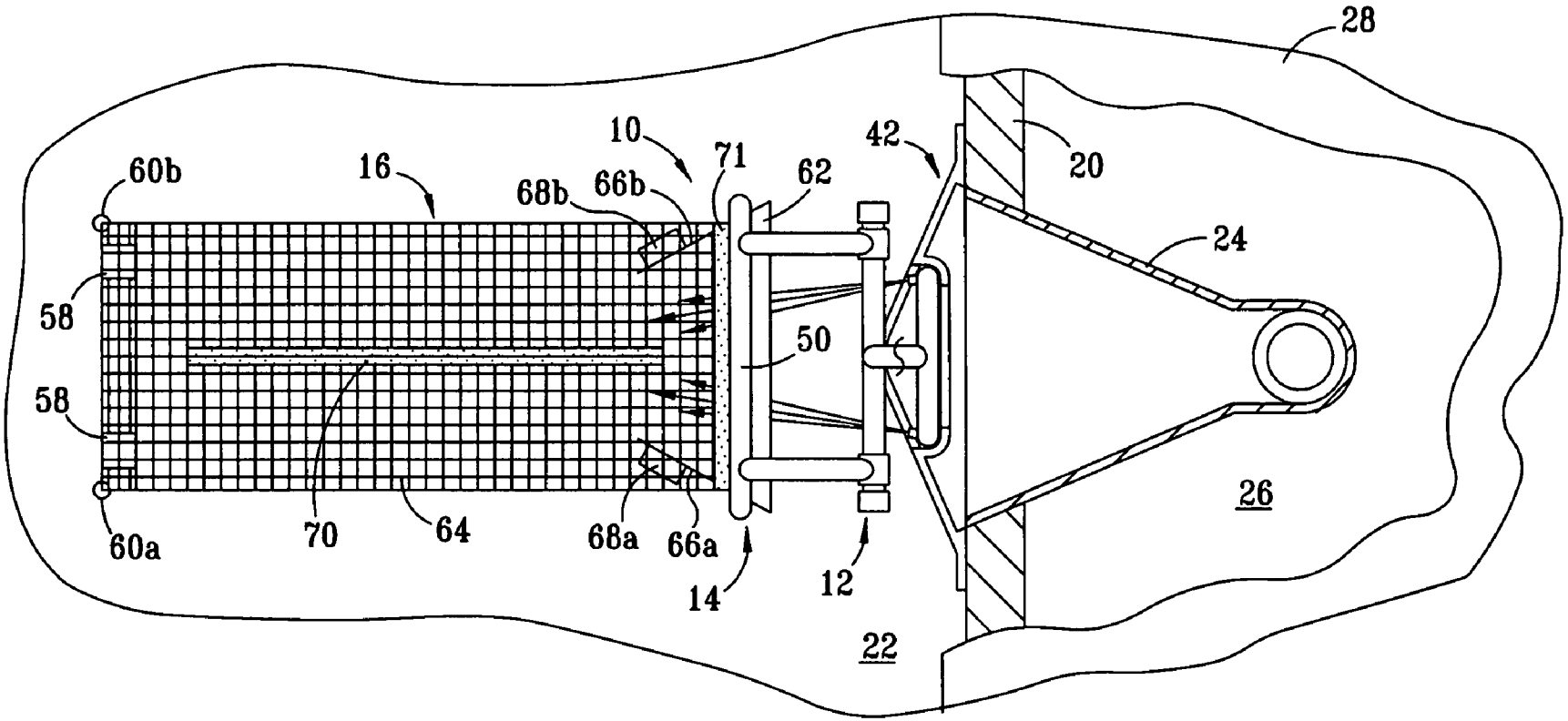
FIG. 2 is a top plan view of the apparatus of the invention installed in the position as shown in FIG. 1, with part of the pool coping and decking above the skimmer installation broken away.

Referring to FIGS. 1 and 2, debris gathering device 10 principally comprises spray head assembly 12, inlet duct assembly 14 and debris collection bag 16, all of which are installable as a unit inside swimming pool 18. In a particularly preferred embodiment of the invention, device 10 further comprises a baffle assembly 42. For purposes of this disclosure, swimming pool 18 is understood to be defined by pool wall 20, which contains water having a surface level 22. According to a preferred embodiment of the invention, pool wall 20 has installed in or through it at least one conventional pool skimmer 24.

Most in-ground pools have at least one, and often two or more, skimmers disposed at locations on opposite sides or ends of a pool. Such skimmers are typically mounted in a fixed position in relation to an in-ground pool such as pool 18 installed in ground 26, and further comprise an inlet positioned so as to receive water whenever surface level 22 of pool 18 is at a normal level. Each such skimmer typically comprises a sump containing a small collection basket that is removable through an opening 36 accessible by removing a cover in pool deck 28 behind coping 30. The bottom of the sump typically has an opening communicating with a water flow line connected to the inlet side of a water pump, as shown in FIG. 1. During operation of the skimmer when device 10 is not installed, a water recirculation pump draws water through the skimmer inlet and into the flow line disposed below the sump, drawing debris floating at surface level into the skimmer, where it eventually settles into the skimmer basket. However, during periods when vegetation surrounding the pool is dropping a large volume of debris that can fall or be blown by wind into the pool, the relatively small skimmer baskets can fill quickly, necessitating that they be emptied several times a day. If the baskets are not emptied, the flow of water through the skimmer can be blocked or significantly reduced, thereby seriously disrupting the flow of debris into the skimmer. When this occurs, a large volume of debris can accumulate quickly on the water surface, where it can soon absorb enough water to cause it to sink to the bottom of the pool, sometimes clogging drains and requiring removal by a pool sweep or net.

By positioning device 10 as disclosed herein in front of a single skimmer, and on windy days, in front of the skimmer most likely to be in a downwind position, one can in most cases gather surface debris from an entire pool without the need for multiple devices and without the need for repeatedly locating device 10. On the other hand, because device 10 is so easily installed and moved, one can, if desired, relocate device 10 if needed with little required time or effort.

As used herein, the term "perpendicular" to the pool wall is used to indicate the direction in which debris collection bag 16 extends outwardly into the pool from the pool wall. Although such direction is generally perpendicular to the pool wall at such point, it should be understood that strict conformity with a 90 degree angle is not required, and that, depending upon other factors such as wind speed and direction, pool geometry, and the like, the angle between the central longitudinal axis of collection bag 16 and the plane of those portions of the pool wall most closely adjacent to spray head assembly 12 can be somewhat greater or less than 90 degrees. In that case, the terminology "perpendicular" or "substantially perpendicular" relative to pool wall 20 is still intended to apply to such a situation or configuration. Similarly, the term "laterally spaced" as used herein is intended to refer to spacing in a direction substantially parallel to the section of pool wall 20 most closely adjacent to device 10, and substantially transverse to the longitudinal axis through device 10 that is substantially perpendicular to pool wall 20. The term "at or near the surface" as used in herein refers generally to debris floating in the top foot of water in pool 18, and most preferably, to debris floating at a level no deeper from surface 22 than the lowest point of the inlet into inlet duct assembly 14, as is discussed in greater detail below. In most cases, debris captured by the preferred embodiment of device 10 as disclosed herein will be floating in the top 4 to 8 inches of water in pool 18.

Figure 9:
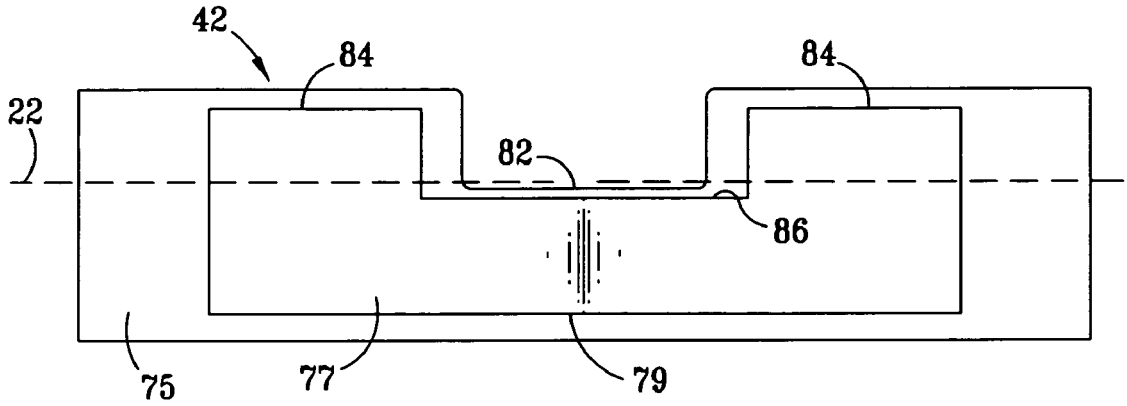
FIG. 9 is a simplified front elevation view of a preferred baffle assembly for use in the apparatus as installed in FIG. 2.
Figure 10:
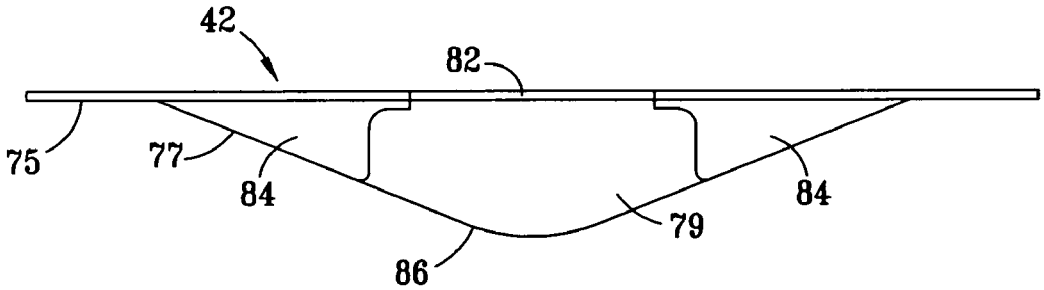
FIG. 10 is a simplified top plan view of the baffle assembly of the apparatus as installed in FIG. 2.
Figure 11:
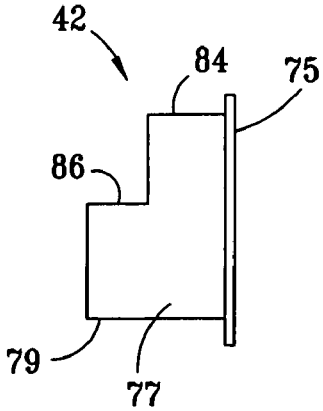
FIG. 11 is a simplified side elevation view of the baffle assembly of the apparatus as installed in FIG. 2.
Figure 12:
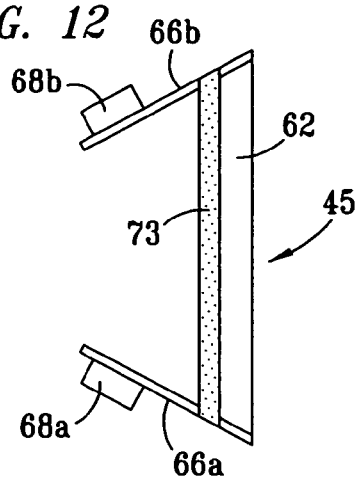
FIG. 12 is a top plan view of a preferred venturi duct for use in the apparatus as installed in FIG. 2.
Figure 13:
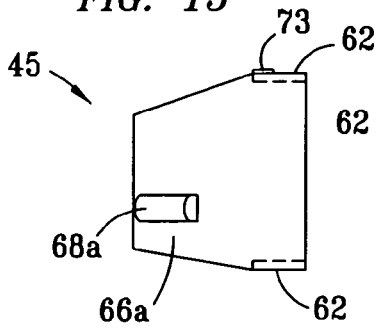
FIG. 13 is a side elevation view of the venturi duct of the apparatus as installed in FIG. 2.
Figure 14:
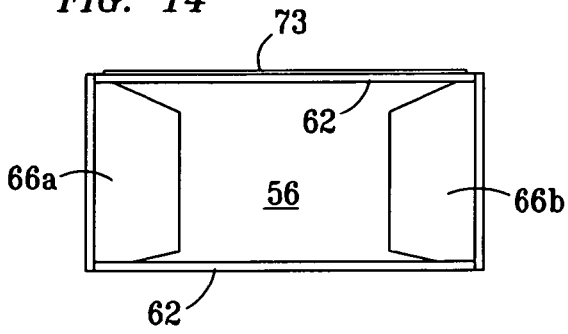
FIG. 14 is a rear elevation view of the venturi duct of the apparatus as installed in FIG. 2.
Figure 15:
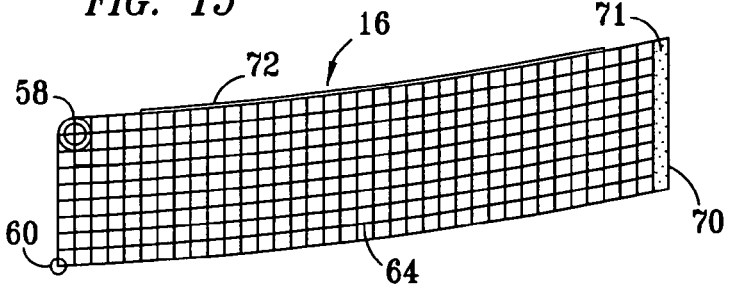
FIG. 15 is a simplified side elevation view of a preferred collection bag for use in the apparatus as installed in FIG. 2.
Figure 16:
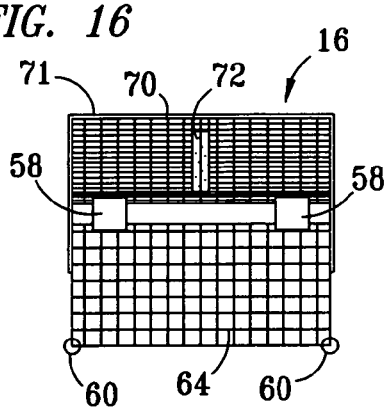
FIG. 16 is a simplified front elevation view of the collection bag of the apparatus as installed in FIG. 2.
Figure 17:
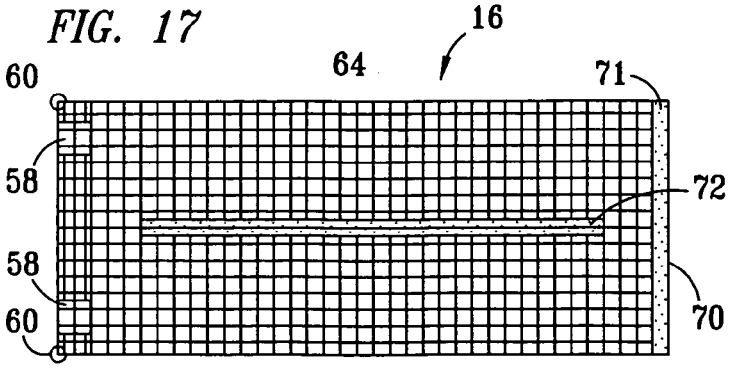
FIG. 17 is a simplified top plan view of the collection bag of the apparatus as installed in FIG. 2.

Referring again to FIGS. 1 and 2, unlike some prior art pool skimmer devices that are designed to be tethered or otherwise installed with the major longitudinal axis being substantially parallel to the pool wall, some of which rely exclusively upon the normal pump circulation in a pool to float debris into a collection, device 10 is preferably installed substantially perpendicular to pool wall 20 and directly in front of a skimmer inlet, with baffle assembly 42 disposed between spray head assembly 12 and skimmer 24. Baffle assembly 42, the structure of which is further described below in relation to FIGS. 9-11, allows water to enter the skimmer inlet, thereby taking advantage of the suction exerted by the skimmer to draw floating debris toward the skimmer inlet from both sides of device 10. However, because of its configuration, baffle assembly 42 blocks any water from entering skimmer 24 except between spray heads 38*a*, 38*b* (discussed below in relation to spray head assembly 12) where baffle 42 cooperates with spray heads 38*a*, 38*b* to redirect the floating debris into inlet duct assembly 14 (as indicated by arrows 40 in FIG. 1) and then into collection bag 16.

Figure 3:
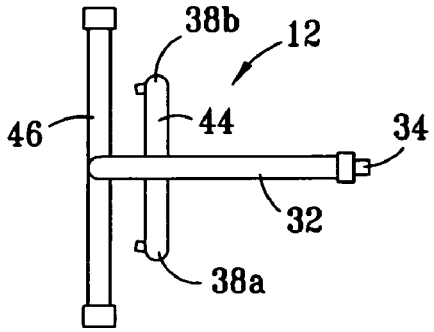
FIG. 3 is a top plan view of a preferred spray head assembly for use in the apparatus as installed in FIG. 2.
Figure 4:
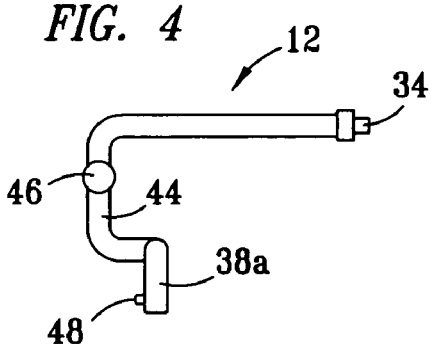
FIG. 4 is a side elevation view of the spray head assembly of the apparatus as installed in FIG. 2.
Figure 5:
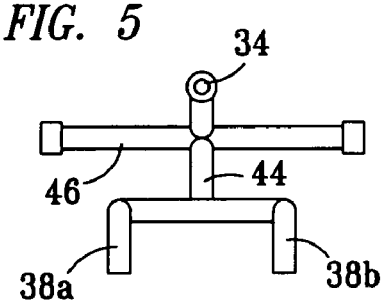
FIG. 5 is a rear elevation view of the spray head assembly of the invention as installed in FIG. 2.
Figure 6:
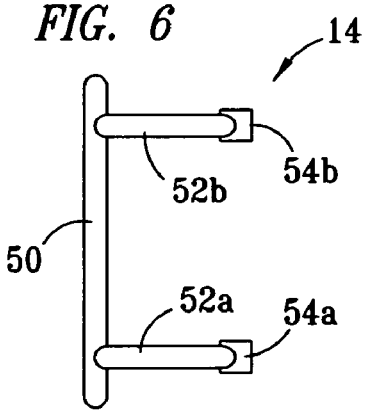
FIG. 6 is a top plan view of a preferred inlet duct assembly for use in the apparatus as installed in FIG. 2.

Referring to FIG. 1, spray head assembly 12 preferably comprises water inlet line 32 having connector 34 (broken away in FIG. 2 to better illustrate baffle assembly 42 and skimmer 24) that is preferably attachable to the end of a conventional water hose 74 (visible in FIG. 18), which serves as an external source of pressurized water at normal line pressure. Connector 34 can be configured so that water hose 74 and water inlet line 32 (FIG. 1) are coaxially aligned, or so that water hose 74 attaches from an angular direction to avoid blocking access to the skimmer basket through skimmer cover 36. Referring also to FIGS. 3-5, spray head assembly 12 preferably further comprises header section 44 providing fluid communication between water inlet line 32 and a plurality of laterally spaced water spray heads such as spray heads 38*a*, 38*b*, and transverse support member 46. Transverse support member 46 is desirably cylindrical or otherwise configured to facilitate releasable engagement with inlet duct assembly 14 in such manner that inlet duct assembly 14 can pivot upwardly or downwardly relative to transverse support member 46 with rising or falling levels of water surface 22 inside pool 18. As illustrated in the drawings, the tubular portions of spray head assembly 12 and inlet duct assembly 14 are constructed from PVC pipe and fittings. It will be appreciated upon reading this disclosure, however, that other metal or polymeric structural members having similar functional characteristics can be substituted for one or more of the elements disclosed herein within the scope of the invention. Header section 44 and spray heads 38*a*, 38*b* are preferably configured so that nozzles 48 are disposed about one inch or less above surface 22 and facing away from skimmer 24 in the direction of collector bag assembly 16, as seen in FIGS. 1 and 2.

One benefit of device 10 is that it can be readily installed and removed from a pool 18 without modification to existing plumbing. Water inlet line 32 is desirably a polymeric flow line, such as PVC pipe or a similarly functional equivalent, that receives water from connector 34 and directs it to a plurality of laterally spaced sprayer heads 38 that discharge sprays of pressurized water toward inlet duct assembly 14 and collection bag 16. Sprayer heads 38 most preferably discharge pressurized water from just above (such as, for example, about one inch or less above) water surface 22, although it will be appreciated upon reading this disclosure that where more than two spray heads 38 and water nozzles 48 are provided, at least some spray heads can have one spray nozzle disposed slightly above surface 22 and another spray nozzle disposed at or slightly below surface 22, to direct converging water sprays toward inlet duct assembly 14 to further improve the effectiveness of device 10 for redirecting floating debris into collection bag 64.

Although device 10 is not shown by the accompanying drawings to be releasably anchored in a preferred position relative to pool wall 20 or skimmer 24 other than by attachment to hose 74 (FIG. 18), it will be appreciated upon reading this disclosure that a bag filled with sand or water, or another similarly effective means, can be placed over hose 74 or water inlet line 32 (FIG. 1) if desired to hold device 10 in a preferred position. Similarly, other portions of spray head assembly 12 or inlet duct assembly 14 can be attached to an anchor point or points on pool deck 28 by other conventional means to locate device 10 in a preferred position relative to pool wall 20 or skimmer 24.

Referring to FIGS. 1-3 and 9-11, baffle assembly 42 is desirably provided and constructed to block the inflow of water into skimmer 24 anywhere except between spray heads 38*a*, 38*b*. Baffle assembly 42 preferably comprises back member 75 having a height and width sufficient to function as a dam and effectively block floating debris from entering skimmer 24 except at the center portion. Some water flow into skimmer 24 is needed in order to help establish a circulation pattern that will draw floating debris toward the skimmer. Between spray heads 38*a*, 38*b*, the top of the baffle is only about one inch below water surface 22 so that debris floating more than about one inch below the water surface is also physically blocked from entering the skimmer. Lighter debris floating in the water passing into skimmer 24 over the center portion of the baffle is desirably contacted and redirected by spray heads 38*a*, 38*b* toward the inlet to the collection bag. The center portion desirably has a width less than the lateral separation of spray heads 38*a*, 38*b* and a top level 82 slightly below water surface 22 to permit skimmer 24 to continue drawing surface water and floating toward the skimmer. According to a preferred embodiment of the invention, baffle assembly 42 further comprises a front member 77 with bottom 79 that is attached to back member 75 and also has a center portion with a top level 86 disposed between two outer portions each having a higher top level 84. Top level 86 of the center portion is again desirably slightly below the water surface 22 to permit the skimmer to continue drawing water toward skimmer 24. Spray heads 38 of spray head assembly 12 are desirably recessed as shown in FIG. 2 and cooperate with baffle assembly 42 to redirect floating debris into the mouth of inlet duct assembly 14 and collection bag 16 without cutting off the water suction being exerted through skimmer 24. Although various commercially available materials known to those of skill in the art can be used to construct baffle assembly 42, front member 77 is most preferably a vacuum-formed PVC sheet that is solvent welded to back member 75, which is preferably made of another polymeric sheet that is cut or stamped or to the desired configuration. If desired, baffle assembly 42 can be made with one or more variable flotation chambers or externally attached flotation devices or weights to better control buoyancy of the resultant assembly during use.

Figure 7:
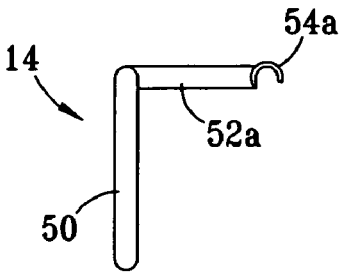
FIG. 7 is a side elevation view of the inlet duct assembly of the apparatus as installed in FIG. 2.
Figure 8:
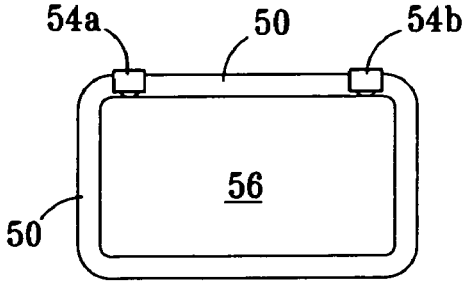
FIG. 8 is a rear elevation view of the inlet duct assembly of the apparatus as installed in FIG. 2.

Referring to FIGS. 1, 2 and 6-8, inlet duct assembly 14 preferably further comprises a lightweight frame 50 defining mouth 56, and a plurality of laterally spaced attachment arms 52*a*, 52*b* having connectors 54*a*, 54*b*, respectively, for use in releasably attaching inlet duct assembly 14 to transverse support member 46 of spray head assembly 12. According to one embodiment of the invention, connectors 54*a*, 54*b* are C-shaped, as shown in FIG. 7, or configured as a flexible split ring or other similarly effective connector, to allow attachment arms 52*a*, 52*b* to rotate or pivot upwardly or downwardly relative to transverse support member 46 while still maintaining the general alignment of inlet duct assembly 14 with spray head assembly 12. The structure and operation of connectors 54*a*, 54*b* will desirably facilitate rapid attachment and detachment of inlet duct assembly 14 relative to spray head assembly 12, and will also provide sufficient engagement that inlet duct assembly 14 will not accidentally detach from spray head assembly 12 as a result of wind, wave action, or the like, during normal use.

Referring to FIGS. 1-2, 8 and 12-14, inlet duct assembly 14 preferably further comprises venturi duct 45 that is slidably engageable into, or otherwise connected or connectable with, lightweight frame 50. Venturi duct 45 is preferably made of a polymeric or lightweight metal material and further comprises top and bottom frame members 62 and oblique side panels 66*a*, 66*b* that effectively narrow mouth 56 and increase the velocity of water flowing between the side panels. As indicated in the drawings, venturi duct 45 is preferably slidably and frictionally engageable with lightweight frame 50. Venturi duct 45 further comprises at least one strip 73 comprising half of a conventional, commercially available hook-and-loop fastener system or other similarly effective means such as ties or the like for releasably attaching collection bag 16 to venturi duct 45. Alternatively, it will be appreciated that venturi duct 45 can be made with strips 73 located around the full perimeter of mouth 56 for attachment to collection bag 16 on four sides of its open end, or collection bag 16 can be made releasably attachable to a portion of inlet duct assembly 14 other than venturi duct 45. Venturi duct 45 is also preferably provided with flotation members 68*a*, 68*b* disposed on oblique side panels 66*a*, 66*b*, respectively, that lend buoyancy to inlet duct assembly and to the open end of collection bag 16, especially as collection bag 16 becomes substantially filled with debris, some of which may by then have become more water-soaked. Flotation members 68*a*, 68*b* desirably prevent the top of mouth 56 of frame 50 and venturi duct 45 from sinking below the surface as collection bag 16 becomes heavier during use. Although inlet duct assembly 14 and venturi duct 45 are disclosed herein as being rectangular in shape, it will be appreciated upon reading this disclosure that other similarly effective shapes and configurations for these structures can likewise be used within the scope of the invention.

Referring to FIGS. 1-2 and 15-17, debris collection bag 16 is preferably an elongate flexible bag made of netting 64 constructed from strands or fibers of a material that is resistant or substantially impervious to the absorption of water. It should be understood, however, that perforated polymeric sheet material or other similarly effective means can also be used to form the top, bottom and side walls of collection bag 16. Collection bag 16 has one open end and one closed end, and must necessarily comprise at least one outlet for water entering open end 70 The openings in netting 64 or other functionally equivalent material are desirably large enough to permit the egress of water along the length of collection bag 16 so that water can still exit the bag freely even when it is substantially full of debris. As shown in the drawings, collection bag 16 preferably has a substantially rectangular cross-section, has a plurality of attachment means such as hook-and-loop fastener strips 71 around its open end 72, and further comprises another releasable closure such as elongate hook-and-loop fastener closure 72 that will facilitate removal of debris from the closed end (the end distal to open end 70) after inlet duct assembly 14 is detached from spray head assembly 12 to remove collection bag 16 from pool 18. Flotation members 58 and weights 60 are preferably provided to help prevent collapse of the closed end of collection bag 16 prior to the time that the closed end is filled with collected debris.

Figure 18:
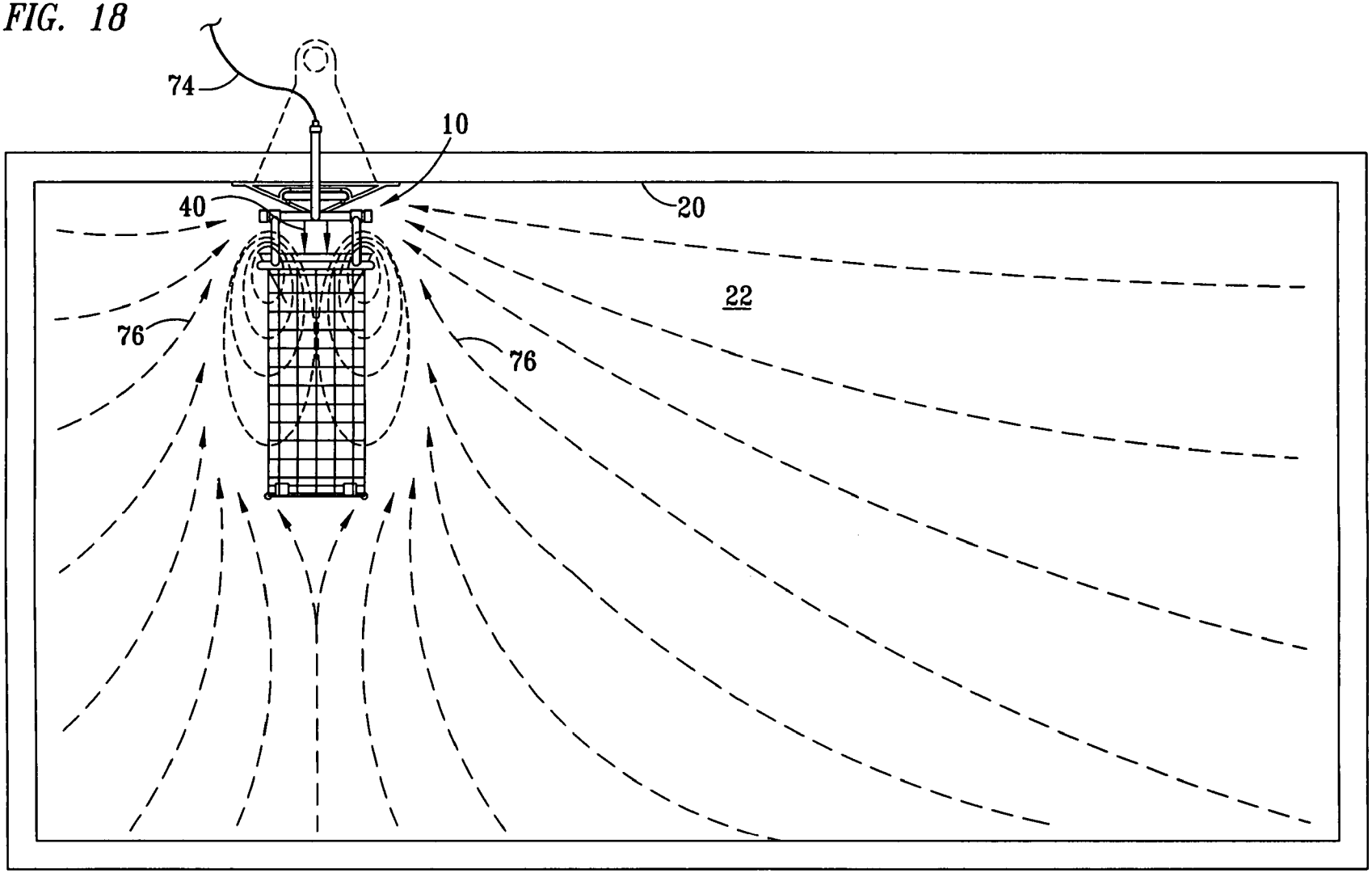
FIG. 18 is a simplified top plan view of a swimming pool in which the apparatus as installed in FIG. 2 is operating, with dashed lines and arrows illustrating the surface water flow pattern established by the subject apparatus during operation.

Although floating debris, such as leaves, blossoms, twigs, other plant parts, paper or plastic scrap, and the like, are not depicted in the drawings to prevent the drawings from being unduly cluttered, it will be appreciated that such floating debris is carried into collection bag 16 by the water spray as indicated by arrows 40 in FIG. 1 in cooperation with the acceleration effect of venturi duct 45 as water moves through mouth 56. As shown in FIG. 18, when made and installed in a pool as disclosed herein, device 10 will cooperate with the natural recirculating water flow toward an in-wall skimmer to first draw, and then propel, debris floating at or near the surface toward the mount of collection bag 16. The circulation of water through collection bag 16 will in turn establish a dual flow pattern at below surface 22 around bag 16 that will help draw floating debris toward device 10 from distances even greater than would otherwise occur simply as a result of the action of the skimmer alone.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A device for gathering debris floating at or near the water surface of a swimming pool having a wall and a skimmer having an inlet disposed in the wall, the device comprising:

a spray head assembly releasably installable at a selected position on a side of the swimming pool, which position is directly in front of the skimmer, the spray head assembly comprising a connector through which a pressurized flow of water is receivable from an external source;

an inlet duct assembly pivotably connected to the spray head assembly; and an elongate debris collection bag releasably attachable to the inlet duct assembly, the collection bag extending into the pool substantially parallel to the surface and substantially perpendicular to a section of the pool wall adjacent to the spray head assembly, and having at least one water outlet disposed distally from the inlet duct assembly.

2. The device of claim 1 wherein the external source is a water hose and wherein the connector is releasably attachable to the water hose.

3. The device of claim 1 wherein the spray head assembly further comprises a water inlet line in fluid communication with a plurality of laterally spaced sprayer heads positioned to discharge water received through the connector toward the inlet duct assembly.

4. The device of claim 3 wherein the plurality of laterally spaced sprayer heads comprise two laterally spaced sprayer heads.

5. The device of claim 4 wherein the sprayer heads cooperate with the pool wall to establish a dual-sided water circulation pattern that causes debris to enter the collection bag from opposite sides of the device.

6. The device of claim 3 wherein at least two of the plurality of laterally spaced sprayer heads are positioned less than one inch above the surface.

7. The device of claim 3 wherein the collection bag has an open end spaced that is spaced apart from the laterally spaced sprayer heads.

8. The device of claim 1, further comprising a baffle assembly disposed between the spray head assembly and the pool skimmer.

9. The device of claim 1 wherein the inlet duct assembly comprises a lightweight frame that is releasably attachable to the spray head assembly.

10. The device of claim 8 wherein the baffle member further comprises at least one flotation portion.

11. The device of claim 9 wherein the collection bag has an open end, and wherein the lightweight frame defines an opening have a shape and size corresponding substantially to the open end of the collection bag.

12. The device of claim 9 wherein the collection bag has an open end that is releasably attachable to and supported in an open position by the lightweight frame.

13. The device of claim 9 wherein the inlet duct assembly further comprises a venturi duct that is engageable with the lightweight frame.

14. The device of claim 1 wherein the inlet duct assembly is pivotably connected to the spray head assembly by a plurality of laterally spaced attachment arms, said pivotable connection allowing the portion of the inlet duct assembly to which the collection bag is attachable to rise and fall with the surface.

15. The device of claim 1 wherein the inlet duct assembly further comprises a venturi duct in fluid communication with the open end of the collection bag.

16. The device of claim 15 wherein the venturi duct further comprises two oppositely disposed, oblique side portions connected to a substantially rectangular support member.

17. The device of claim 1 wherein the inlet duct assembly further comprises at least one flotation member.

18. The device of claim 1 wherein the collection bag comprises a closed end and at least one collapse-prevention member maintaining the closed end in an expanded configuration.

19. The device of claim 18 wherein the at least one collapse-prevention member comprises at least one flotation member and at least one weighted member, the at least one flotation member and at least one weighted member being oppositely disposed in the closed end of the bag and cooperating to prevent the closed end of the bag from sinking deeply below the surface and thereby hindering the collection of floating debris.

20. The device of claim 18 wherein the at least one collapse-prevention member comprises at least one flotation member and at least one weighted member, the at least one flotation member and at least one weighted member being oppositely disposed in the closed end of the bag and cooperating to prevent the closed end of the bag from collapsing and thereby hindering the collection of floating debris.

21. The device of claim 1 wherein the collection bag comprises an open end, a closed end, and a releasable closure disposed between the open end and the closed end.

22. The device of claim 1 wherein the collection bag has a length and a width, with the length being at least two times the width.

23. The device of claim 1 wherein the collection bag is made of netting having openings smaller than a major portion of the floating debris.

* * * * *